US007613306B2

(12) United States Patent
Miyasaka et al.

(10) Patent No.: US 7,613,306 B2
(45) Date of Patent: Nov. 3, 2009

(54) AUDIO ENCODER AND AUDIO DECODER

(75) Inventors: Shuji Miyasaka, Osaka (JP); Yoshiaki Takagi, Kanagawa (JP); Kazutaka Abe, Osaka (JP)

(73) Assignee: Panasonic Corporation, Osaka (JP)

( * ) Notice: Subject to any disclaimer, the term of this patent is extended or adjusted under 35 U.S.C. 154(b) by 341 days.

(21) Appl. No.: 10/586,905

(22) PCT Filed: Feb. 9, 2005

(86) PCT No.: PCT/JP2005/001968

§ 371 (c)(1),
(2), (4) Date: Jul. 24, 2006

(87) PCT Pub. No.: WO2005/081229

PCT Pub. Date: Sep. 1, 2005

(65) Prior Publication Data

US 2007/0162278 A1 Jul. 12, 2007

(30) Foreign Application Priority Data

Feb. 25, 2004 (JP) ..... 2004-049650

(51) Int. Cl.
*H04R 5/00* (2006.01)

(52) U.S. Cl. ..... 381/22; 381/119; 700/94

(58) Field of Classification Search ..... 381/2, 381/27, 17–19, 22, 23, 119; 700/94; 704/500, 704/501, 200.1
See application file for complete search history.

(56) References Cited

U.S. PATENT DOCUMENTS 5,781,237 A * 7/1998 Fukuda ..... 375/240.04
7,260,540 B2 * 8/2007 Miyasaka et al. ..... 704/500
2003/0093264 A1 5/2003 Miyasaka et al.

FOREIGN PATENT DOCUMENTS

| | | | |
|---|---|---|---|
| JP | 7-264582 | | 10/1995 |
| JP | 2000-295698 | * | 10/2000 |
| JP | 2001-100792 | * | 4/2001 |
| JP | 2003-218701 | | 7/2003 |
| WO | 03/042981 | | 5/2003 |

OTHER PUBLICATIONS

Information Technology—"*Generic Coding of Moving Pictures and Audio: Audio*", ISO/IEC 13818-3, Feb. 20, 1997, pp. ii-117.

* cited by examiner

*Primary Examiner*—Vivian Chin
*Assistant Examiner*—Lun-See Lao
(74) *Attorney, Agent, or Firm*—Wenderoth, Lind & Ponack, L.L.P.

(57) ABSTRACT

An audio encoder, generating a stereo signal based on a multi-channel signal, includes a downmix unit for downmixing a multi-channel signal exceeding two channels to a two-channel stereo signal, a first coding unit for generating a first coded signal by coding the downmixed stereo signal, a second coding unit for generating a second coded signal by coding information to restore the downmixed stereo signal to a multi-channel signal, a code size calculating unit for calculating a code size of the second coded signal, and a first multiplexing unit for multiplexing the calculated code size in either the first coded signal or the second coded signal. Accordingly a decoder is able to easily extract a coded signal of the multi-channel signal based on the code size, and the decoder reproducing only the downmixed signal can be configured inexpensively.

7 Claims, 13 Drawing Sheets

FIG. 3A $$\begin{bmatrix} \text{Left ch} \\ \text{Right ch} \\ \\ \\ \end{bmatrix} = \begin{bmatrix} 1 & 0 & 1 & 0 \\ 0 & 1 & 0 & 1 \\ & & & \\ & & & \end{bmatrix} \begin{bmatrix} \text{Front left ch} \\ \text{Front right ch} \\ \text{Rear left ch} \\ \text{Rear right ch} \end{bmatrix}$$

FIG. 3B $$\begin{bmatrix} \text{Left ch} \\ \text{Right ch} \\ \text{Left' ch} \\ \text{Right' ch} \end{bmatrix} = \begin{bmatrix} 1 & 0 & 1 & 0 \\ 0 & 1 & 0 & 1 \\ 0 & 0 & -1 & 0 \\ 0 & 0 & 0 & -1 \end{bmatrix} \begin{bmatrix} \text{Front left ch} \\ \text{Front right ch} \\ \text{Rear left ch} \\ \text{Rear right ch} \end{bmatrix}$$

FIG. 3C $$\begin{bmatrix} \text{Front left ch} \\ \text{Front right ch} \\ \text{Rear left ch} \\ \text{Rear right ch} \end{bmatrix} = \begin{bmatrix} 1 & 0 & 1 & 0 \\ 0 & 1 & 0 & 1 \\ 0 & 0 & -1 & 0 \\ 0 & 0 & 0 & -1 \end{bmatrix} \begin{bmatrix} \text{Left ch} \\ \text{Right ch} \\ \text{Left' ch} \\ \text{Right' ch} \end{bmatrix}$$

FIG. 4A $$\begin{bmatrix} \text{Left ch} \\ \text{Right ch} \\ \text{Left' ch} \\ \text{Right' ch} \end{bmatrix} = \begin{bmatrix} a & b & c & d \\ e & f & g & h \\ i & j & k & l \\ m & n & o & p \end{bmatrix} \begin{bmatrix} \text{Front left ch} \\ \text{Front right ch} \\ \text{Rear left ch} \\ \text{Rear right ch} \end{bmatrix}$$

FIG. 4B $$\begin{bmatrix} \text{Front left ch} \\ \text{Front right ch} \\ \text{Rear left ch} \\ \text{Rear right ch} \end{bmatrix} = \begin{bmatrix} a & b & c & d \\ e & f & g & h \\ i & j & k & l \\ m & n & o & p \end{bmatrix}^{-1} \begin{bmatrix} \text{Left ch} \\ \text{Right ch} \\ \text{Left' ch} \\ \text{Right' ch} \end{bmatrix}$$

AUDIO ENCODER AND AUDIO DECODER

BACKGROUND OF THE INVENTION

1 Technical Field

The present invention relates to an audio encoder which codes a multi-channel signal, and particularly relates to an audio encoder which generates a coded signal that allows the multi-channel signal to be reproduced by an inexpensive decoder.

The present invention also relates to an audio decoder which decodes the coded signal encoded by the aforementioned audio encoder, and particularly relates to an audio decoder which reproduces the multi-channel signal by two channels.

2 Background Art

Conventionally researches and developments related to an audio encoder, which generates a coded signal that allows the multi-channel signal to be reproduced by an inexpensive reproducing device especially by a two-channel reproducing device, have been carried out. For example the MPEG-2 audio standard (ISO13818-3) discloses a technique that a signal downmixed from a multi-channel signal to a two-channel signal and a signal to restore the downmixed signal to a multi-channel signal are separated from each other, and then the signals are coded as a first coded signal and a second coded signal respectively, and only the first coded signal can be decoded by an inexpensive decoder. (Non-patent reference 1: the MPEG-2 audio standard, ISO13818-3)

However there has been a problem that separating the first coded signal and the second coded signal is not easy in the MPEG-2 audio standard.

FIG. 1 shows a structure of a coded signal (bit stream) by the MPEG-2 audio standard. In FIG. 1, the frame header information 900 indicates a start position of coded information for one frame coded every 1152 samples. A first coded signal 901 is a coded signal generated by coding a stereo signal downmixed from a multi-channel signal to a two-channel signal. A second coded signal 902 is a coded signal obtained by coding information to restore the downmixed signal to a multi-channel signal.

Now it is assumed that a decoder is expected to decode only the first coded signal 901. For example, a decoder in a cellular phone or the like designed presuming only two-channel reproduction obtains and decodes the first coded signal 901. And then the decoder is expected to skip the second coded signal 902. However, is not possible to obtain the size of the second coded signal 902 easily due to the following reason, so that it is not easy to skip the second coded signal 902. The frame size of each frame can be obtained easily by analyzing the frame header information 900 of each frame. However the code size of the first coded signal 901 is variable for each frame as exemplified in the figure, and thus the code size of the second coded signal 902 is naturally variable. Hence the code size of the second coded signal 902 can be found only by deducting the code size of the first coded signal 901 of the frame from the frame size of the frame concerned. Consequently at the time of decoding the first coded signal 901, the code size of the first coded signal 901 needs calculations each time. As a result, there exists a problem that a large volume of operation resources needs to be spent undesirably.

Additionally, the following problem is also apparent in the conventional technique.

According to the MPEG-2 audio standard, since the decoded downmixed signal is downmixed by a specified matrix operation at the time of sampling, the original spatial information of the multi-channel signal seems to be lost. Accordingly in the case where the signal downmixed to a two-channel signal is expected to be reproduced after reproducing the original spatial information, in other words, in the case where the two-channel signal to which virtual surround-sound processing being applied is expected to be reproduced, the spatial information needs to be executed filter processing based on a head-related transfer function after the multi-channel signal is decoded using the first coded signal 901 and the second coded signal 902. As a result there exists a problem that a large volume of operation resources needs to be spent undesirably.

In view of these existing problems, an object of the present invention is to provide an audio encoder which generates a coded signal having a code size that can be easily found. Here the coded signal is the coded information to restore the downmixed signal to a multi-channel signal.

The second object of the present invention is to provide an audio encoder which generates coded information, which makes it possible to reproduce the spatial information of the original multi-channel by reproducing only the downmixed signal.

The third object of the present invention is to provide an audio decoder which decodes the coded signal which has been coded by such an audio encoder with less amount of operation.

Summary of the Invention

In order to achieve the aforesaid objects, an audio encoder of the present invention is characterized by including: a downmix unit to downmix a multi-channel signal exceeding two channels to a two-channel stereo signal; a first coding unit to generate a first coded signal by coding the downmixed stereo signal; a second coding unit to generate a second coded signal by coding information for restoring the downmixed stereo signal to a multi-channel signal; a code size calculating unit to calculate a code size of the second coded signal; and a multiplexing unit to multiplex the first coded signal, the second coded signal and a signal representing the calculated code size.

In addition, the multiplexing unit may include a first multiplexing unit to multiplex the code size calculated by the code size calculating unit and the second coded signal; and a second multiplexing unit to multiplex the first coded signal with the second coded signal in which the code size is multiplexed.

In addition, the first multiplexing unit may multiplex the code size calculated by the code size calculating unit, placing the code size at the head of the second coded signal.

In addition, the first multiplexing unit may multiplex the code size calculated by the code size calculating unit, placing the code size immediately after an indicator to identify the start of the second coded signal.

In addition, the first multiplexing unit may multiplex the code size in the second coded signal by describing the code size calculated by the code size calculating unit in variable length.

In addition, the downmix unit may perform an operation using a head-related transfer function, and perform downmix processing on the multi-channel signal.

In addition, the downmix unit may perform the operation using the head-related transfer function on the multi-channel signal in a frequency domain.

In addition, the second coded signal may have invalid data, and the code size calculating unit may calculate a code size of the second coded signal having the invalid data.

In order to solve the aforesaid problem, the audio decoder of the present invention includes an obtaining unit to obtain coded signals having a) a first coded signal obtained by coding a two-channel stereo signal downmixed from a multi-channel signal exceeding two channels, b) a second coded signal obtained by coding information for generating a multi-channel signal from the stereo signal, and c) a signal representing a code size of the second coded signal, and a decoding unit to decode the obtained coded signals, and to output a stereo signal.

In addition, the decoding unit includes: a first coded signal readout unit to read the first coded signal out of the obtained coded signals; a code size readout unit to read a signal representing a code size of the second coded signal out of the coded signals; and a first decoding unit to decode the first coded signal read out by the first coded signal readout unit, and to output the stereo signal, and the first coded signal readout unit may skip the second coded signal based on a signal representing the code size read out by the code size readout unit.

In addition, the first coded signal is coded from a stereo signal to which virtual surround-sound effect is applied beforehand by the operation using a head-related transfer function, and the first decoding unit may output the stereo signal to which virtual surround-sound effect is applied.

In addition, the audio decoder may further include: a second coded signal readout unit to read the second coded signal out of the coded signals; a second decoding unit to decode a multi-channel signal based on the read-out first coded signal and the read-out second coded signal; a filter unit to perform filter processing to the decoded multi-channel signal based on the head-related transfer function, and to output the stereo signal to which virtual surround-sound effect is applied; and a selecting unit to select one of the stereo signal outputted out of the first decoding unit and the stereo signal to which virtual surround-sound effect is applied outputted out of the filter unit.

In addition, the first decoding unit may generate a frequency domain signal of the stereo signal, and the filter unit may perform filter processing based on the head-related transfer function to the frequency domain signal of the restored multi-channel signal from the frequency domain signal of the stereo signal, generate a two-channel frequency domain signal, and subsequently convert the frequency domain signal to a time domain signal.

In addition, the audio decoder may further include: an electric power supplying unit to supply electric power in order to drive at least the second decoding unit; and the selecting unit to select the stereo signal from the first decoding unit in a case where the electric supply from the electric supply unit falls to below a predetermined value.

In addition, the signal representing the code size of the second coded signal read out by the code size readout unit may be a signal representing a code size of the second coded signal including invalid data.

According to the present invention, it becomes possible to generate a coded signal that makes it easy to find a code size of the second coded signal for an audio decoder. Here the second coded signal is obtained by coding necessary information to restore the downmixed signal to a multi-channel signal. Hence a reproducing device for reproducing only a downmixed signal is able to decode and reproduce only the downmixed signal easily.

According to the present invention, a signal representing the code size of the second coded signal can be obtained from the position located immediately after the start position of the second coded signal.

According to the present invention, the signal representing the code size of the second coded signal can be multiplexed by variable code lengths depending on the value, so that the number of bits for multiplexing the signal representing the code size can be reduced.

Further according to the present invention, since downmix processing can be executed on frequency domain, in a case where the second coding unit executes coding processing for signal in a frequency domain, the downmix processing and the second coding processing can be executed efficiently as a result.

According to the present invention, the first coding unit handles signals in a band not more than one half, so that compressing ratio can be improved. In a case where only the coded signal coded by the first coding unit is reproduced, a reproducing device handles signals in a band not more than one half, so that the number of operations for decoding can be reduced. Besides a band expanding technology (ISO/IEC14496-3) whose extensive research and development being recently carried out is a technology to increase the signal in a band not more than one half, so that the interfacing with the technology can be facilitated.

Besides, according to the present invention, the downmixed signal becomes the signal to which filter processing of the head-related transfer function is executed. Hence in a case where only the first coded signal is reproduced, the original multi-channel spatial information is reflected.

Furthermore, according to the present invention, the downmixed signal becomes the signal to which filter processing of the head-related transfer function is executed. Hence in a case where only the first coded signal is reproduced, the original multi-channel spatial information is reflected. Moreover the processing of the head-related transfer function is executed in a frequency domain. Thus in a case where the audio compression technologies, which are major in recent years such as the AAC standard (ISO/IEC13818-7) and the AAC-SBR standard (ISO/IEC 14496-3), are combined, the processing can be executed with less number of operations. This is because these standards are the methods of compression coding for the signal in a frequency domain.

Furthermore, according to the present invention, in a case where only the downmixed signal is expected to be decoded, it is possible to remove information for multi channellizing by easy processing.

Furthermore, according to the present invention, it is possible to choose either a reproduction sound of the downmixed signal or a reproduction sound of a multi-channel signal to which filter processing based on the head-related transfer function being executed.

Furthermore, according to the present invention, after filter processing based on the head-related transfer function in a frequency domain is executed, and then a frequency domain signal for two channels is generated. The frequency domain signal can be converted into a time domain signal, and in the case where the audio compression technologies, which are major in recent years such as the AAC standard (ISO/IEC13818-7) and the AAC-SBR standard (ISO/IEC 14496-3), are combined, the processing can be executed with less number of operations. This is because these standards are the methods of compression coding for the signal in a frequency domain.

Furthermore, according to the present invention, in a case where the power to drive the audio decoder is decreased, for example, the audio decoder runs low on the battery, the mode is automatically shifted to decoding the downmixed signal automatically, so that the battery life is extended. The listener is able to know that the audio decoder runs low on the battery by the change of audio quality.

BRIEF DESCRIPTION OF DRAWINGS

FIG. 3A is a diagram showing a transformation matrix of downmix. FIG. 3B is a diagram showing a matrix to generate a signal for restoring a downmixed signal to an original multi-channel signal. FIG. 3C is a diagram showing a matrix for restoring the downmixed signal to the original multi-channel signal.

FIG. 4A is a diagram showing an example of a matrix of a case where the matrix shown in FIG. 3B is calculated based on a head-related transfer function. FIG. 4B is a matrix inverse of a matrix of FIG. 4A, and is a drawing showing an example of a matrix for restoring the downmixed signal to the original multi-channel signal.

Figure 1:
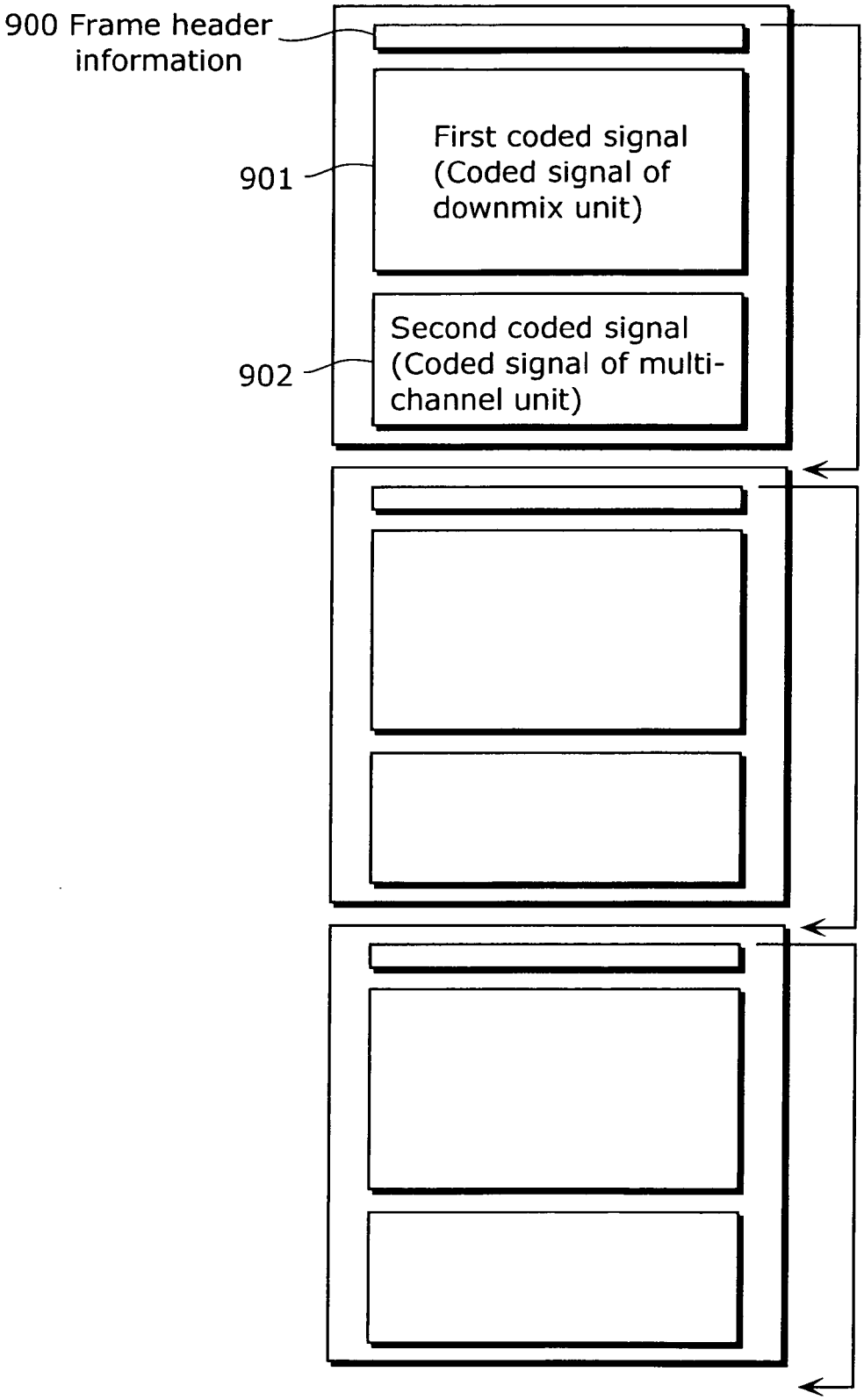
FIG. 1 shows the structure of a coded signal (bit stream) by the MPEG-2 audio standard.

Numerical References
100 and 500 Downmix unit
101 and 501 First coding unit
102 and 502 Second coding unit
103 and 503 Code size calculating unit
104 and 504 First multiplexing unit
105 and 505 Second multiplexing unit
600, 700 and 800 First coded signal extracting unit
601, 701 and 801 Second coded signal extracting unit
602, 702 and 802 First decoding unit
603, 703 and 803 Code size extracting unit
604, 704 and 804 Substantial signal extracting unit
705 and 805 Second decoding unit
706 and 806 Filter unit
707 and 807 Selecting unit
900 Frame header information
901 The first coded signal
902 The second coded signal

DETAILED DESCRIPTION OF THE INVENTION

THE FIRST EMBODIMENT

Figure 2:
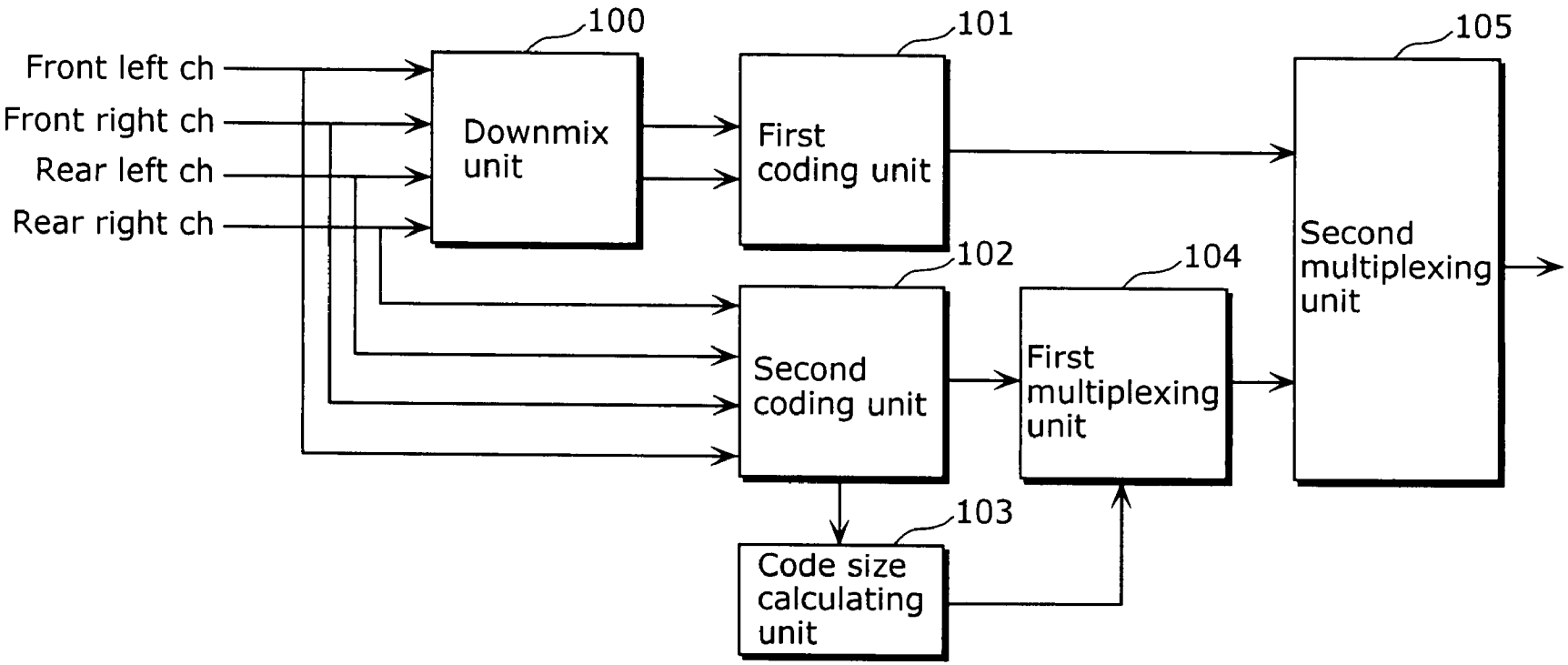
FIG. 2 is a block diagram showing a configuration of an audio encoder of the first embodiment.

Here an audio encoder of the first embodiment of the present invention will be described referring to drawings. FIG. 2 is a diagram showing a configuration of the audio encoder of the first embodiment. The audio encoder of the first embodiment shown in FIG. 2 is an audio encoder which describes a signal representing a code size of the second coded signal at the head of the second coded signal for each frame, and one frame includes variable-length of the first coded signal and the second coded signal respectively. The audio encoder includes a downmix unit 100, a first coding unit 101, a second coding unit 102, a code size calculating unit 103, a first multiplexing unit 104 and a second multiplexing unit 105. The first coded signal is obtained by coding a stereo signal of two channels obtained by downmixing a multi-channel signal. The second coded signal is obtained by coding information to restore the original multi-channel signal from the first coded signal. The downmix unit 100 downmixes a multi-channel signal of M channels (M is a natural number satisfying M>2) to a stereo signal. It should be noted that hereinafter the stereo signal obtained by downmixing the multi-channel signal is called a "downmixed signal". The first coding unit 101 generates the first coded signal by coding the downmixed signal. The second coding unit 102 codes information to restore the downmixed signal to a multi-channel signal. The code size calculating unit 103 calculates the code size of the coded signal coded by the second coding unit 102. The first multiplexing unit 104 multiplexes the code size calculated by the code size calculating unit 103 and the signal coded by the second coding unit 102, and then generates the second coded signal. The second multiplexing unit 105 multiplexes the first coded signal and the second coded signal.

The operation of the audio encoder configured as mentioned above will be described hereinafter. Firstly, the downmix unit 100 receives a multi-channel signal of four channels (Front left ch, Front right ch, Rear left ch and Rear right ch) as an input in the present embodiment, and downmixes the multi-channel signal to a stereo signal. As a method, it is common to use a transformation matrix. In such a method, a matrix operation is executed as shown in FIG. 3A for example and as a result Left ch is newly obtained from (Front Left ch+Rear left ch) and right ch is newly obtained from (Front right ch+Rear right ch). Alternatively as specified in the MPEG-2 audio standard, a signal of each channel for input is converted to a frequency domain signal using a filter bank, and downmixing may be executed depending on the transformation matrix determined for each frequency band. Or downmixing can be executed depending on the transformation matrix determined for each frequency coefficient by converting a signal of each channel for input to a frequency coefficient by using an orthogonal transformation method such as Fast Fourier Transform (FFT). In this case, each frequency coefficient may be a complex number like a Fourier coefficient.

Next the first coding unit 101 codes the downmixed signal downmixed in a frequency domain or on a time domain, and then the first coded signal is generated. Here coding by the first coding unit 101 may be executed using a coding method defined by the MPEG standard and the like.

Next the second coding unit 102 codes information to restore the downmixed signal to a multi-channel signal. For example the second coding unit 102 codes a signal generated by an auxiliary matrix operation to hold an inverse transformation matrix operation corresponding to a transformation matrix operation used for downmixing. An easiest example is shown in FIG. 3B. In fact the signals of Left' ch and Right' ch which are the results of a calculation by the matrix operation for the shaded lines in FIG. 3B are coded. Accordingly as long as the signal is coded, transferred and stored along with the signal which is coded the downmixed signal, it is possible to restore the downmixed signal to a multi-channel signal of four channels (Front left ch, Front right ch, Rear left ch and Rear right ch) by a matrix inverse operation as shown in FIG. 3C. FIG. 4A is a diagram showing an example of a matrix having coefficients which are obtained by calculating a matrix shown in FIG. 3B based on the head-related transfer function (HRTF). FIG. 4B is a matrix inverse of a matrix of FIG. 4A, and is a drawing showing an example of a matrix for restoring the downmixed signal to the original multi-channel signal. The coefficients a, b, c, d, e, f, g, h, i, j, k, l, m, n, o and p of FIG. 4A and FIG. 4B are coefficients calculated based on the head-related transfer function (HRTF). By using the matrix based on the head-related transfer function, the original multi-channel spatial information is reflected to a two-channel stereo signal represented by Left ch and Right ch. Such processing may be executed to a time domain signal of input. In this case the processing may be executed according to the transformation matrix determined at each frequency band by transforming the time domain signal of input to a frequency domain signal using a filter bank and the like alternatively. As another method, the processing may be executed according to the transformation matrix determined for each frequency coefficient by transforming the time domain signal of input to a frequency coefficient using the orthogonal transformation method like FFT. In this case, each frequency coefficient may be a complex number like Fourier coefficient.

Next the code size calculating unit 103 calculates the code size of the signal coded by the second coding unit 102. However in a case where the area, in which the coded signal obtained by coding a signal by the second coding unit 102 should be described, includes invalid data other than the signal coded by the second coding unit 102 like null, the code size calculating unit 103 calculates the code size including such invalid data. In other words, the code size mentioned in the Claims and here represents a code size including such invalid data, in a case where the area in which coded signal obtained by coding a signal by the second coding unit 102 should be described includes such invalid data.

Figure 5:
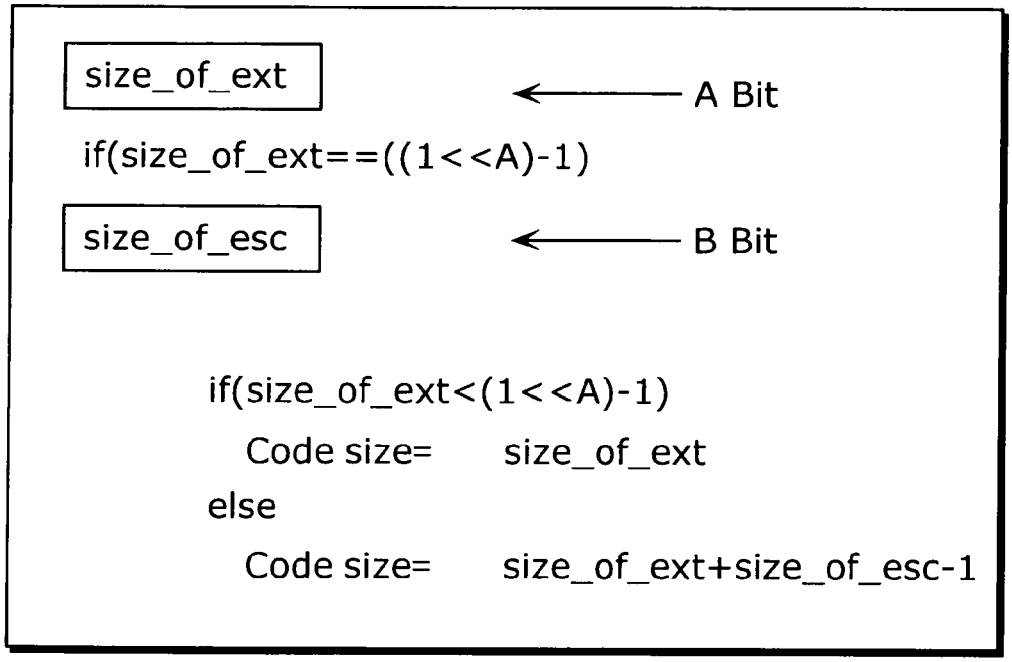
FIG. 5 is a diagram showing an example of a description method to describe a code size calculated by a code size calculating unit 103 in the coded signal.
Figure 6:
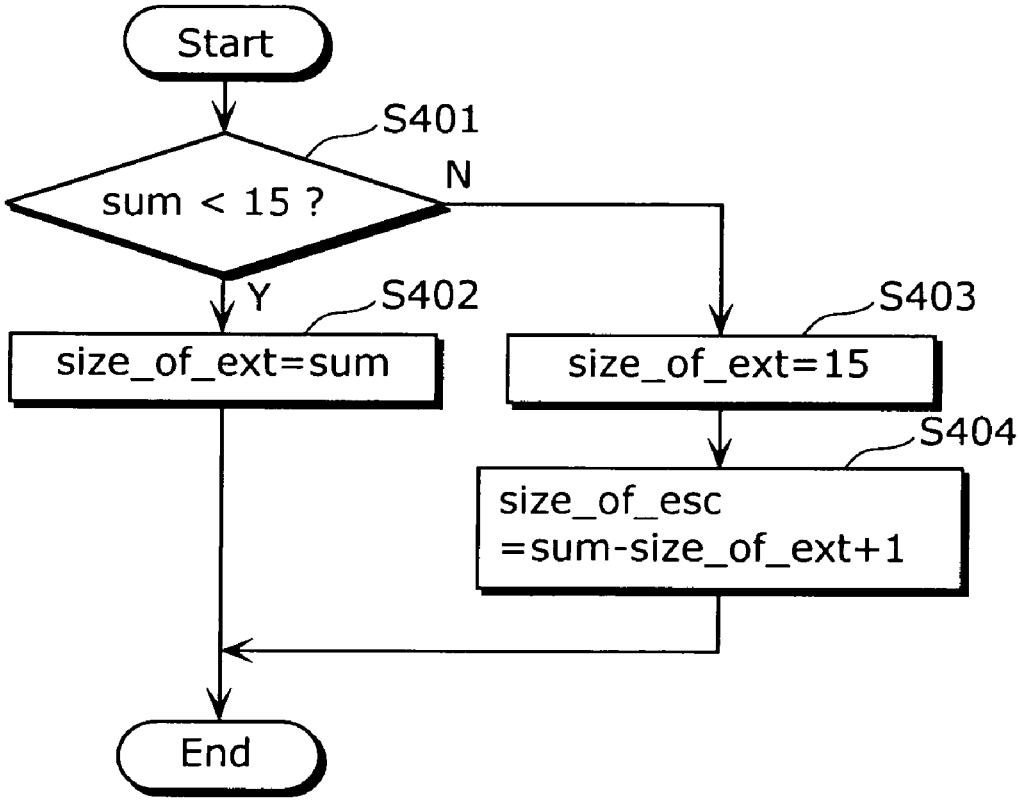
FIG. 6 is a flowchart of processes for describing the code size in the coded signal by the description method shown in FIG. 5.

Next the first multiplexing unit 104 multiplexes the code size calculated by the code size calculating unit 103 and the signal generated by the second coding unit 102, and then generates the second coded signal. FIG. 5 is a diagram showing an example of a description method to describe a code size calculated by the code size calculating unit 103 in the coded signal. FIG. 6 is a flowchart of processes for describing the code size by the description method shown in FIG. 5 to the coded signal. Here the code size calculated by the code size calculating unit 103 is represented by a variable length of bit field of A bits or (A+B) bits. More particularly in a case where the calculated code size is represented by A bits, described only by size_of_ext, and in a case where the code size exceeds A bits, represented by two fields of size_of_ext and size_of_esc. For example in a case where A is 4, B is 8 and the code size sum is 14 bytes, since 14 can be represented by 4 bits of binary 1110 (S401), and binary 1110 representing sum=14 is described in 4 bits field of size_of_ext (S402). In an if-statement representing this condition, since value 14 of size_of_ext is (1<<4)−1, which is smaller than 15 obtained by deducting one from value 16 that is shifted one by four bits left, 8 bits field as size_of_esc does not exist. Actually in this case, a signal representing a code size in 4 bits of bit field is multiplexed.

Furthermore, for example, in a case where A is 4, B is 8 and the code size sum is 100 bytes (S401), binary 1111 is described in 4 bits field of size_of_ext (S403). In an if-statement representing this condition, since value of size_of_ext is equal to (1<<4)−1, that is 15, value of sum−size_of_ext+1=100−(15−1) is described in 8 bits field of size_of_esc. (S404). Actually in this case, a signal representing a code size in 12 bits of bit field is multiplexed.

Figure 7:
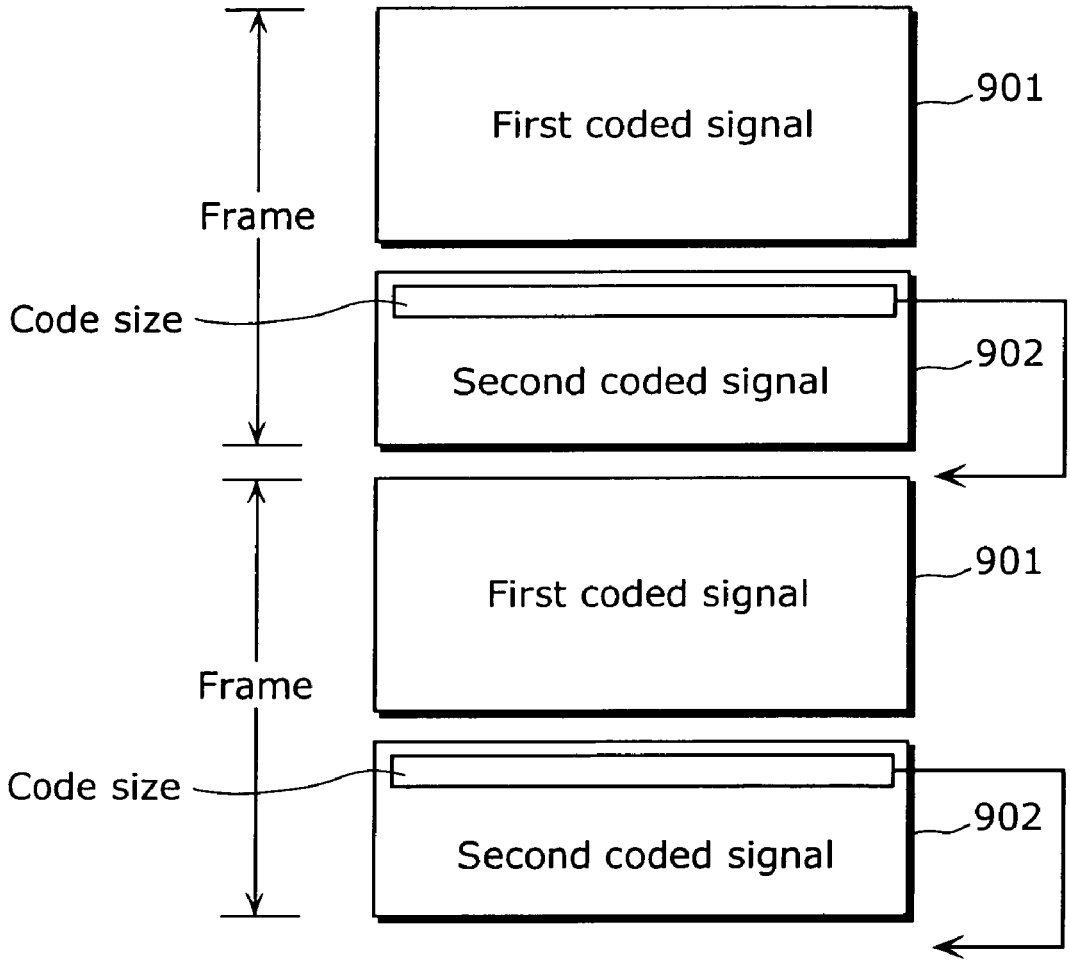
FIG. 7 is a diagram showing a data structure of a coded signal generated in a first embodiment and a second embodiment.

Finally in the second multiplexing unit 105, the first coded signal 901 and the second coded signal 902 are multiplexed. By executing this processing for each audio frame sequentially, the first coded signal 901 and the second coded signal 902 are multiplexed by turns as shown in FIG. 7, and also a coded signal such as a multiplexed signal representing a code size in the head of the second coded signal 902 is generated.

As mentioned above, according to the present embodiment, the encoder includes the downmix unit for downmixing the multi-channel signal of M channels (M>2) to the stereo signal, the first coding unit 101 for generating the first coded signal by coding the downmixed signal, the second coding unit 102 for coding information to restore the downmixed signal to the multi-channel signal, the code size calculating unit 103 for calculating the code size of the signal coded by the second coding unit 102, the first multiplexing unit 104 for multiplexing the code size calculated by the code size calculating unit and the signal generated by the second coding unit 102, and the second multiplexing unit 105 for multiplexing the first coded signal and the second coded signal. The first multiplexing unit 104 multiplexes the signal representing the code size by placing the signal representing the code size at the head of the second coded signal, and for the decoder decoding only the first coded signal and reproducing only the downmixed signal, the information indicating the code size of the second coded signal is included in the second coded signal, so that it is possible to easily remove the second coded signal from the entire coded signal.

It is obvious that the signal representing the code size is desirable to be multiplexed so as to place the signal representing the code size immediately after an indicator for identifying the start of the second coded signal. The reason is that, for a decoder expected to decode only the first coded signal and to reproduce only the downmixed signal, when the information indicating the code size of the second coded signal is placed at the head of the second coded signal, it is easy to remove the second coded signal from the entire coded signal. It should be noted that the code size of the second coded signal may be described in Fill Element of the coded signal of the MPEG-2. In this case, the indicator for identifying the start of the second coded signal is an indicator showing the start of Fill Element.

Furthermore by way of multiplexing the calculated code size to a variable length bit field depending on the bit size for representing the code size, it is possible to reduce the number of bits for multiplexing the signal representing the code size.

Furthermore in the present embodiment, four-channel is exemplified as the number of channels for the multi-channel signal. However it is not necessary to be four and it is obvious that generally-popular 5.1 channels can be used.

It should be noted that the signal representing the calculated code size is desirable to be described at the head of the second coded signal. However the present invention is not limited to this. For example the signal representing the calculated code size may be described in the frame header information. Alternatively the signal representing the code size of the first coded signal may be described in the frame header information. Since the code size of the entire frame is described in the frame header information, it is possible to calculate the code size of the second coded signal easily.

THE SECOND EMBODIMENT

Figure 8:
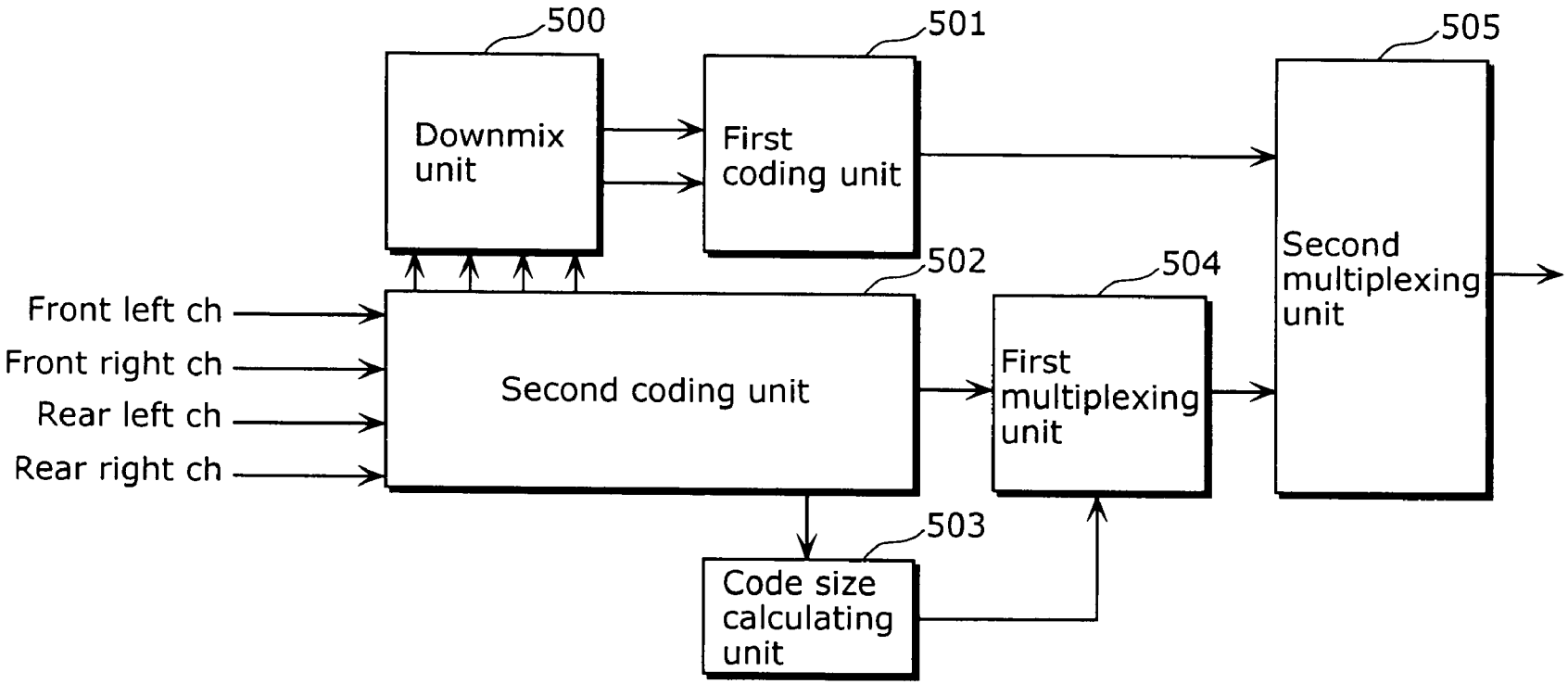
FIG. 8 is a diagram showing a configuration of an audio encoder of the second embodiment.

Here an audio encoder of the second embodiment of the present invention will be described referring to drawings. FIG. 8 is a diagram showing a configuration of an audio encoder of the second embodiment. The audio encoder of FIG. 8 is an audio encoder for transforming a 4-channel signal on a time domain inputted to a signal in a frequency domain, and subsequently downmixing the signal. The audio encoder includes a downmix unit 500, a first coding unit 501, a second coding unit 502, a code size calculating unit 503, a first multiplexing unit 504 and a second multiplexing unit 505. Here the second coding unit 502, the code size calculating unit 503, the first multiplexing unit 504 and the second multiplexing unit 505 are the same units as shown in the first embodiment. The second embodiment is different from the first embodiment in that: the downmix unit 500 is configured so that it receives a frequency domain signal of each input channel generated in the processing stage of the second coding unit 502 as input, and a part of the frequency domain signal of each input channel or the frequency domain signal of the band is downmixed; and the first coding unit 501 is configured so that the downmix unit 500 receives the downmixed signal as input and the first coding unit 501 codes the downmixed signal.

The operation of the audio encoder configured as mentioned above is described hereinafter. Firstly, the second coding unit 502 transforms the inputted 4-channel signal to a frequency domain signal including the same number of samples as the signal on a time domain. A filter bank may be used for the transforming, or the signal may be transformed to frequency coefficient using the orthogonal transformation method like FFT. In this case, each frequency coefficient may be a complex number like Fourier coefficient. The frequency domain signal of each channel is outputted to the downmix unit 500, and then downmix processing is executed by a predetermined method in the downmix unit 500. Here the downmix processing executed to the corresponding frequency domain signal for each channel can be executed by a matrix operation as mentioned in the first embodiment. On the other hand, the second coding unit 502 codes information to restore the downmixed signal to a multi-channel signal. This method also can be the same as the method described in the first embodiment.

Here in the embodiment, the downmix unit 500 may execute downmix processing to only the part of the band of the frequency domain signal for the received respective channels. For example, the signal, which is removed a part of the upper side of the entire frequency band, is downmixed. Accordingly for a decoder expected to decode only the first coded signal and to reproduce only the downmixed signal, the frequency band of the coded signal is narrow, so that the number of the operations can be less number of operations for decoding. Further in a case where the signal in a frequency band not more than one half of the entire frequency band is downmixed, further convenience can be expected by the reason shown hereinafter. Actually the first coding unit 501 can use a coding method specified in the MPEG standard. Especially here, when the frequency band is not more than one half of the entire frequency band, the frequency band conforms to the frequency band presumed in the band expanding technology (ISO/IEC14496-3) being examined in the MPEG4 standard in recent years, so that the interfacing with the technology can be facilitated.

The processing of the code size calculating unit 503, the first multiplexing unit 504 and the second multiplexing unit 505 are the same as that of the units mentioned in the first embodiment.

Furthermore, the downmix unit 500 may execute filter processing based on the head-related transfer function to the signal decomposed to frequency components concurrently with downmixing. The filter processing based on the head-related transfer function to the signal decomposed to frequency components may be executed by a method as described in Japanese Laid-Open Patent Application No. H11-032400. By using this method, in a case where only the coded signal obtained by coding a signal by the first coding unit 501 is reproduced, the original multi-channel spatial information is reflected. It is obvious that this is not only applied to the processing stage in the second embodiment, but also executed in the processing stage of the first embodiment.

As mentioned above, according to the embodiment, the audio encoder includes: the downmix unit 500 for downmixing a multi-channel signal of M channels (M>2) to a stereo signal, the first coding unit 501 for generating the first coded signal by coding the downmixed signal; the second coding unit 502 for coding information to restore the downmixed signal to a multi-channel signal; the code size calculating unit 503 for calculating a code size of a signal coded in the second coding unit 502; the first multiplexing unit 504 for multiplexing the signal representing the code size calculated by the code size calculating unit 503 and the signal generated in the second coding unit 502 and for generating a second coded signal; and the second multiplexing unit 505 for multiplexing the first coded signal and the second coded signal. The downmix unit 500 is able to execute downmix processing in a frequency domain by transforming a multi-channel signal to a frequency domain signal respectively and downmixing a signal in a part of or all of frequency bands of the frequency domain signal. As a result it is possible to execute processing of downmixing and the second coding efficiently, in a case where the second coding unit 502 executes coding processing on a signal in the frequency domain. Further in a case where a part of or all of signals in a frequency band are downmixed to stereo signals, it is possible to execute downmix processing with less number of operations, while the first coding unit 501 handles signals in a narrow band, so that compressing ratio can be improved. Further in a case where only the coded signal generated by coding a signal by the first coding unit 501 is reproduced, the signals in a narrow band are handled, so that the number of operations for decoding can be less number of operations. Further in a case where downmix processing is executed in the band of one half of the original frequency band, the first coding unit 501 handles signals in one half of the band, so that compressing ratio can be improved, and also in a case where only the coded signal generated by coding a signal by the first coding unit 501 is reproduced, the signals in not more than one half of the band are handled, so that the number of operations for decoding can be less number of operations. Besides, the band expanding technology (ISO/IEC14496-3) is a technology to expand a band not more than one half for a signal, so that the interfacing with the technology can be facilitated.

Furthermore, by executing the filter processing of the head-related transfer function concurrently with the downmix processing, in a case where only the coded signal obtained by coding a signal by the first coding unit 501 is reproduced, the original multi-channel spatial information is reflected.

It is obvious that the filter processing of the head-related transfer function may be executed on a time domain not executed in a frequency domain.

Furthermore, four-channel is exemplified as the number of channels for the multi-channel signal in the embodiment. However it is not necessary to be four and it is obvious that generally-popular 5.1 channels can be used.

THE THIRD EMBODIMENT

Here an audio decoder of the third embodiment of the present invention will be described referring to drawings. The audio decoder is an audio decoder for decoding the coded signal generated by coding a signal in the first embodiment or the second embodiment. In fact, the audio decoder is a decoder for decoding a coded signal which is multiplexed a first coded signal and a second coded signal. Here the first coded signal is generated by downmixing a multi-channel signal of M channels (M>2) to a stereo signal and then coding the stereo signal, and the second coded signal is generated by coding the information to restore the downmixed signal to a multi-channel signal. Here a value indicating a code size of the second coded signal is multiplexed in the second coded signal.

Figure 9:
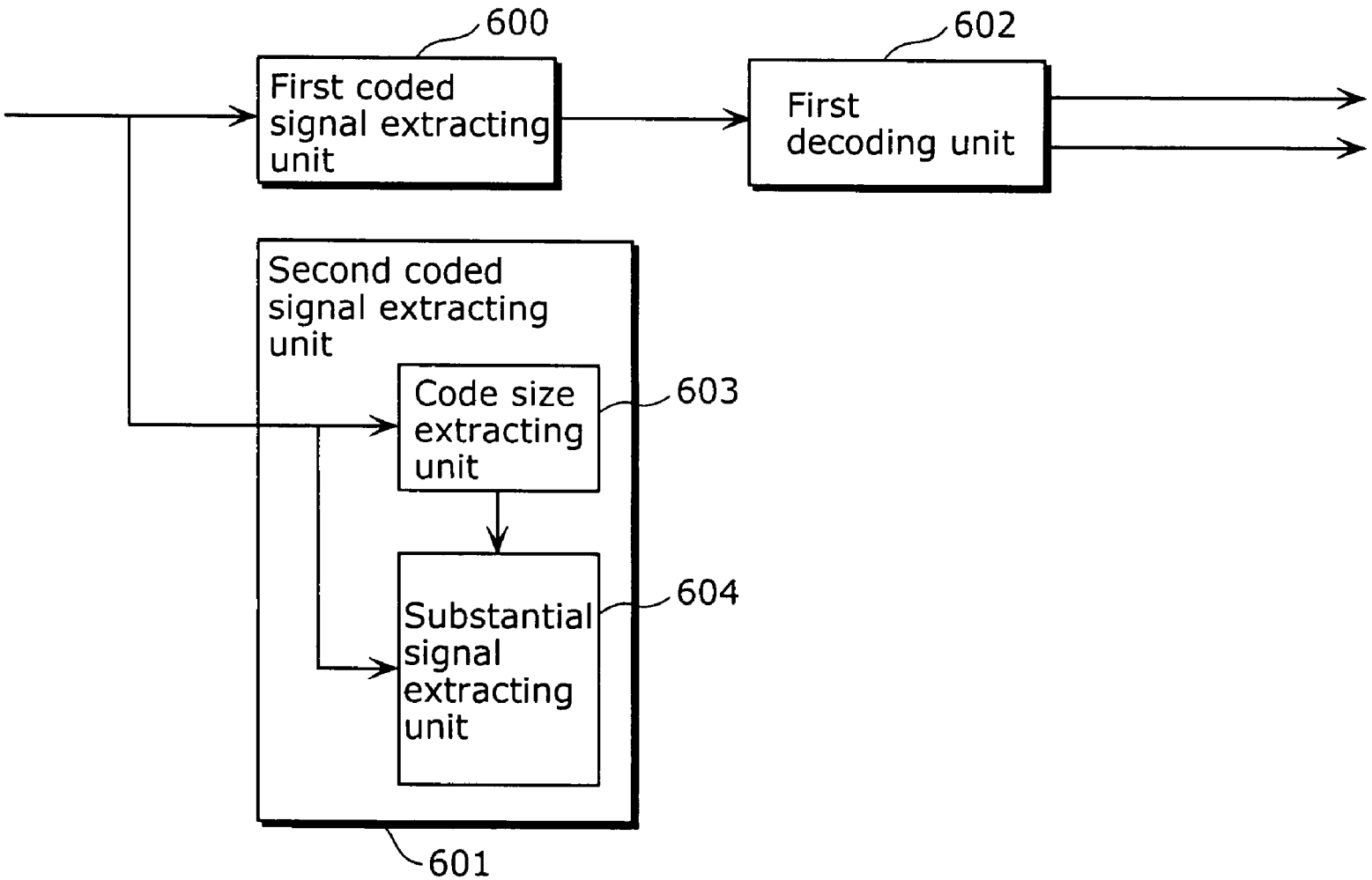
FIG. 9 is a diagram showing a configuration of an audio decoder of a third embodiment.

FIG. 9 is a diagram showing a configuration of an audio decoder of the third embodiment. In FIG. 9, the audio decoder includes a first coded signal extracting unit 600, a second coded signal extracting unit 601, a first decoding unit 602, a code size extracting unit 603 and a substantial signal extracting unit 604. The first coded signal extracting unit 600 extracts the first coded signal. The second coded signal extracting unit 601 extracts the second coded signal. The first decoding unit 602 decodes the downmixed signal based on the first coded signal. The code size extracting unit 603 extracts the signal indicating the code size of the second coded signal included in the second coded signal. The substantial signal extracting unit 604 extracts the second coded signal out of the coded signals based on the signal indicating the code size which has been extracted by the code size extracting unit 603.

Here the operation of the audio decoder configured as above will be described. Firstly, the first coded signal extracting unit 600 extracts the first coded signal out of the coded signal in which the first coded signal and the second coded signal are multiplexed, and here the first coded signal is generated by downmixing a multi-channel signal of 4 channels to a stereo signal and then coding the stereo signal, and the second coded signal is generated by coding the information to restore the downmixed signal to a multi-channel signal. Here the first coded signal is the coded signal generated in the first embodiment and the second embodiment, so that the first coded signal extracting unit 600 may extract the first coded signal in conformity with the coding format of the first coded signal. For example, in a case where the first coding unit is a coding unit conforming to the MPEG standard AAC system, the first coded signal extracting unit 600 may extract the first coded signal conforming to the AAC coding format.

Next the downmixed signal is decoded based on the first coded signal in the first decoding unit 602. As for the decoding method here, the decoding can be executed conforming to the coding standard of the first coded signal.

Figure 10:
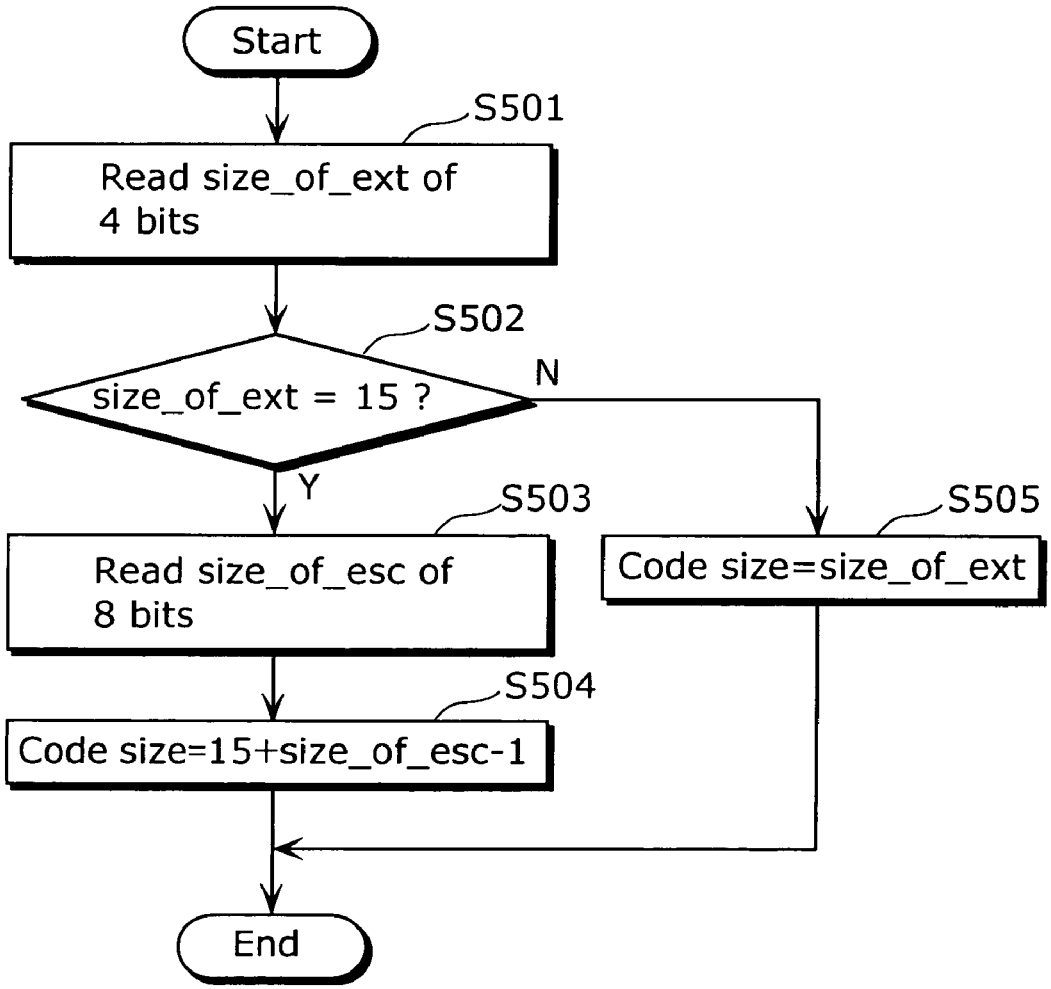
FIG. 10 is a flowchart showing a process of a case where a signal representing the code size described by the code size describing method shown in FIG. 5 is read out by the audio decoder.

FIG. 10 is a flowchart showing a process in a case where a signal representing the code size described by the code size describing method shown in FIG. 5 is read out by the audio decoder. Next the signal representing the code size of the second coded signal included in the second coded signal is extracted by the code size extracting unit 603 built in the second coded signal extracting unit 601 (S501). Here the code size sum is represented in A bits or (A+B) bits as shown in FIG. 5. For example assuming that size_of_ext is 4 bits, size_of_esc is 8 bits and the value of size_of_ext is 1010 in binary. In this case, the value of size_of_ext is 10, that is not equal to (1<<4)−1=15 (S502). Therefore 8 bits of size_of_esc does not exist, the code size sum is 10 bytes (S505). Additionally for example in a case where size_of_ext is 4 bits, size_of_esc is 8 bits, and the value of size_of_ext is 1111 in binary, the value of size_of_ext is (1<<4)−1=15 (S502), therefore 8 bits of size_of_esc exists. The code size extracting unit 603 further extracts 8 bits of size_of_esc (S503). Here in a case where the value of size_of_esc is 00001000 in binary, the code size sum is sum=size_of_ext+size_of_esc−1=15+8−1, and that becomes 22 bytes (S504).

Lastly, the second coded signal is extracted out of the coded signals based on the signal indicating the code size, which has been extracted by the code size extracting unit 603 in the substantial signal extracting unit 604. For example in a case where the code size is 20 bytes, it is possible to recognize that the subsequent signals of 20 bytes are the code size of the second coded signal obtained by coding information to restore the downmixed signal to a multi-channel signal. Therefore the second coded signal is not necessary for the decoder, which just reproduces the downmixed signal, and the coded signal by that size can be skipped.

Here the value corresponding to the code size multiplexed in the second coded signal is not necessarily to be identical to the code size of the signal generated by coding the information to restore the downmixed signal to a multi-channel signal, but the value can be either the identical or greater. For example in a case where the net code size of the signal, that is the coded information to restore the downmixed signal to a multi-channel signal, is 18 bytes, when 2 bytes of additional information is added (it is not necessary that the information is substantially significant), the value, which corresponds to the code size being multiplexed in the second coded signal should be 20. In fact it is the same as the case that the second coded signal includes 2 bytes of additional information or insignificant information. Accordingly the substantial signal extracting unit is not necessary to relate to the content of the coded signal.

As mentioned above, the audio decoder of the embodiment includes 1) the first coded signal extracting unit 600 for extracting the first coded signal out of the coded signal in which the first coded signal and the second coded signal are multiplexed, and here the first coded signal is generated by downmixing a multi-channel signal of M channels (M>2) to a stereo signal and then coding the stereo signal, and the second coded signal is generated by coding the information to restore the downmixed signal to a multi-channel signal, 2) the second coded signal extracting unit 601 for extracting the second coded signal, and 3) the first decoding unit 602 for decoding the downmixed signal based on the first coded signal. The second coded signal extracting unit 601 includes the code size extracting unit 603 indicating a code size included in the second coded signal, and the substantial signal extracting unit 604 extracting the second coded signal out of the coded signals based on the signal indicating the code size extracted by the code size extracting unit 603. According to this in a case of the audio decoder which is expected only to decode the downmixed signal, it is possible to remove or skip the information for multi-channellizing by easy processing.

Of course here, the signal representing the code size is preferably placed at the head of the second coded signal. This is because that for the decoder expected to decode only the first coded signal and to reproduce only the downmixed signal, it is possible to easily remove the second coded signal out of the entire coded signal in a case where the information indicating the code size of the second coded signal is placed at the head of the second coded signal.

Additionally in a case where the original multi-channel signal is downmixed to 2-channel signal by filter processing based on the head-related transfer function beforehand, for the decoder expected to decode only the first coded signal and to reproduce only the downmixed signal, it is possible to reproduce the audio reflected the original multi-channel spatial information by decoding just the first coded signal.

Further in the embodiment, four-channel is exemplified as the number of channels for multi-channel signal as a simplified example. However it is not necessary to be four-channel and it is obvious that generally-popular 5.1 channels can be used.

THE FOURTH EMBODIMENT

Here an audio decoder of the fourth embodiment of the present invention will be described referring to drawings.

The audio decoder is an audio decoder for decoding the coded signal generated by coding a signal in the first embodiment or the second embodiment. In fact, the audio decoder is a decoder for decoding a coded signal in which a first coded signal and a second coded signal are multiplexed. Here the first coded signal is generated by downmixing a multi-channel signal of M channels (M>2) to a stereo signal and then coding the stereo signal, and the second coded signal is generated by coding the information to restore the downmixed signal to a multi-channel signal.

Figure 11:
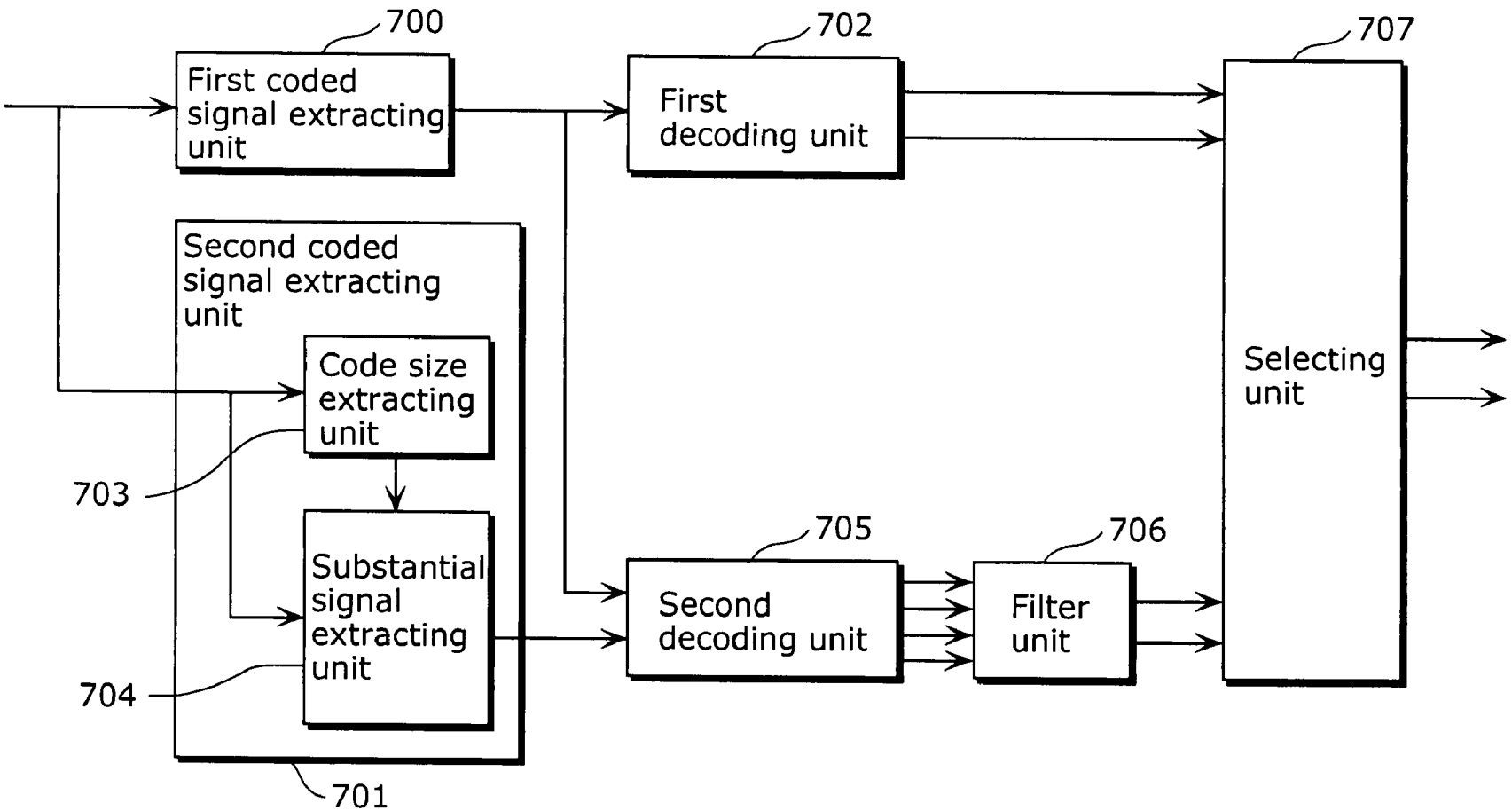
FIG. 11 is a diagram showing a configuration of an audio decoder of the fourth embodiment.

FIG. 11 is a diagram showing a configuration of an audio decoder of the fourth embodiment. As shown in FIG. 11, the audio decoder in the fourth embodiment includes a first coded signal extracting unit 700, a second coded signal extracting unit 701, a first decoding unit 702, a code size extracting unit 703, a substantial signal extracting unit 704, a second decoding unit 705, a filter unit 706 and a selecting unit 707. The different points from the third embodiment are that the audio decoder in the fourth embodiment includes a second decoding unit 705 for decoding the multi-channel signal based on the first coded signal and the second coded signal, a filter unit 706 for executing filter processing based on the head-related transfer function to the decoded multi-channel signal and the selecting unit 707 for selecting a signal generated in the first decoding unit 702 or a signal generated in the filter unit 706. The rest of the units that are the first coded signal extracting unit 700, the second coded signal extracting unit 701, the first decoding unit 702, the code size extracting unit 703 and the substantial signal extracting unit 704, are the same units as mentioned in the third embodiment.

Here the operation of the audio decoder configured as above will be described. Firstly, the first coded signal extracting unit 700 extracts the first coded signal out of the coded signal in which the first coded signal and the second coded signal are multiplexed, and here the first coded signal is generated by downmixing a multi-channel signal of 4 channels to a stereo signal and then coding the stereo signal, and the second coded signal is generated by coding the information to restore the downmixed signal to a multi-channel signal. This operation is same as the third embodiment.

Secondly the downmixed signal is decoded based on the first coded signal in the first decoding unit 702. This operation is also same as the third embodiment.

Next the signal representing the code size of the second coded signal included in the second coded signal is extracted in the code size extracting unit 703 which is built in the second coded signal extracting unit 701. This operation is same as the third embodiment.

Next the substantial signal extracting unit 704 extracts the second coded signal out of the coded signals based on the signal representing the code size extracted by the code size extracting unit 703. This operation is same as the third embodiment.

Next the multi-channel signal is decoded based on the first coded signal and the second coded signal in the second decoding unit 705.

Here the first coded signal and the second coded signal are the coded signals generated by the audio encoder in the first embodiment or the second embodiment, therefore the multi-channel signal may be generated by decoding the first coded signal and the second coded signal in conformity with the coding format in the second decoding unit 705.

Next filter processing based on the head-related transfer function to the decoded multi-channel signal is executed in the filter unit 706.

Finally, the selecting unit 707 selects a signal generated either in the first decoding unit or in the filter unit.

As mentioned above, it is possible for a user to select either the reproduced sound of the downmixed signal or the reproduced sound executed filter processing using the head-related transfer function to the multi-channel signal by including 1) the first coded signal extracting unit 700 for extracting the first coded signal from the coded signal in which the first coded signal and the second coded signal are multiplexed, and here the first coded signal is generated by downmixing a multi-channel signal of M channels (M>2) to a stereo signal and then coding the stereo signal, and the second coded signal is generated by coding the information to restore the downmixed signal to a multi-channel signal, 2) the second coded signal extracting unit 701 for extracting the second coded signal, 3) the first decoding unit 702 for decoding the downmixed signal based on the first coded signal, 4) the code size extracting unit 703 for extracting a signal representing the code size included in the second coded signal, 5) the substantial signal extracting unit 704 for extracting the second coded signal out of the coded signals based on the signal representing the code size extracted by the code size extracting unit 703, 6) the second decoding unit 705 for decoding the multi-channel signal based on the first coded signal and the second coded signal, 7) the filter unit 706 for executing filter processing based on the head-related transfer function for the decoded multi-channel signal, and 8) the selecting unit 707 for selecting signal generated either in the first decoding unit or in the filter unit 706.

In the processing mentioned above, a frequency domain signal of each multi-channel signal may be generated in the second decoding unit 705, after a frequency domain signal of two channels is generated by executing filter processing based on the head-related transfer function in a frequency domain to a frequency domain signal of each multi-channel signal, and then the frequency domain signal may be transformed into a time domain signal. For example, the method described in Japanese Laid-Open Patent Application No. H11-032400 may be used. By using such a method, in a case where the AAC standard (ISO/IEC13818-7) and the AAC-SBR standard (ISO/IEC 14496-3) are combined, the number of operations can be reduced to a large extent. Since these standards are the standard for compressed coded signal in a frequency domain, the processing for transformation from a frequency domain signal into a time domain signal can be executed only by the part of 2 channels, by downmixing in a frequency domain.

Further in the embodiment, four-channel is exemplified as the number of channels for the multi-channel signal. However it is not necessary to be four and it is obvious that generally-popular 5.1 channels can be used.

Figure 12:
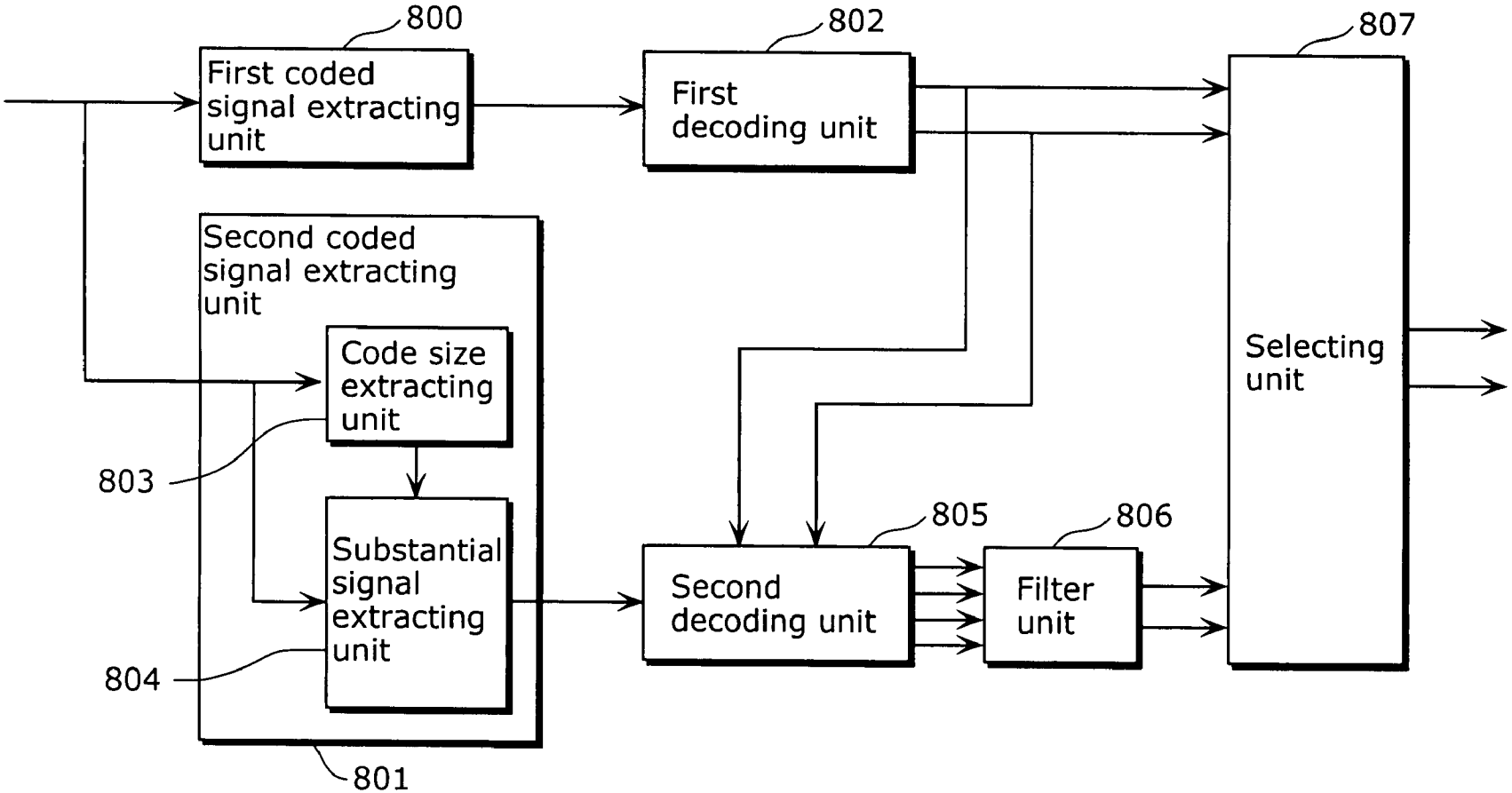
FIG. 12 is a diagram showing another configuration of the audio decoder of the fourth embodiment.

Additionally, the first coded signal and the second coded signal are the inputted signals in the second decoding unit in the present embodiment, and the multi-channel signal is decoded using these coded signals. Alternatively the multi-channel signal may be decoded using the signal decoded in the first decoding unit. FIG. 12 is a diagram showing another configuration of the audio decoder of the fourth embodiment. The configuration of the case is shown in FIG. 12.

Besides, in a case where the power to drive the audio decoder is decreased, for example the audio decoder runs low on the battery, when the shortage of the electric power is detected, and the audio decoder automatically controls the selecting unit to output the signal generated in the first decoding unit automatically, the mode is shifted to a decoding of the downmixed signal. Thus the battery life is extended. Additionally the listener is able to find a shortage of the battery by a change of the audio quality.

Figure 13A:
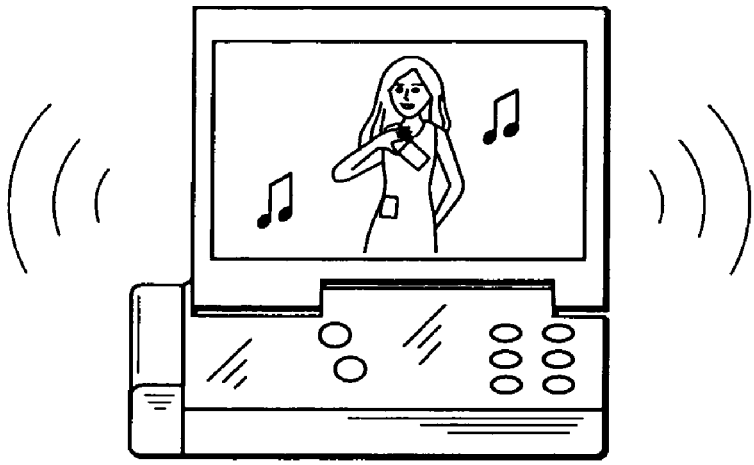
FIG. 13A is a diagram showing an appearance of a mobile television with a built-in audio decoder as an example of the present invention.
Figure 13B:
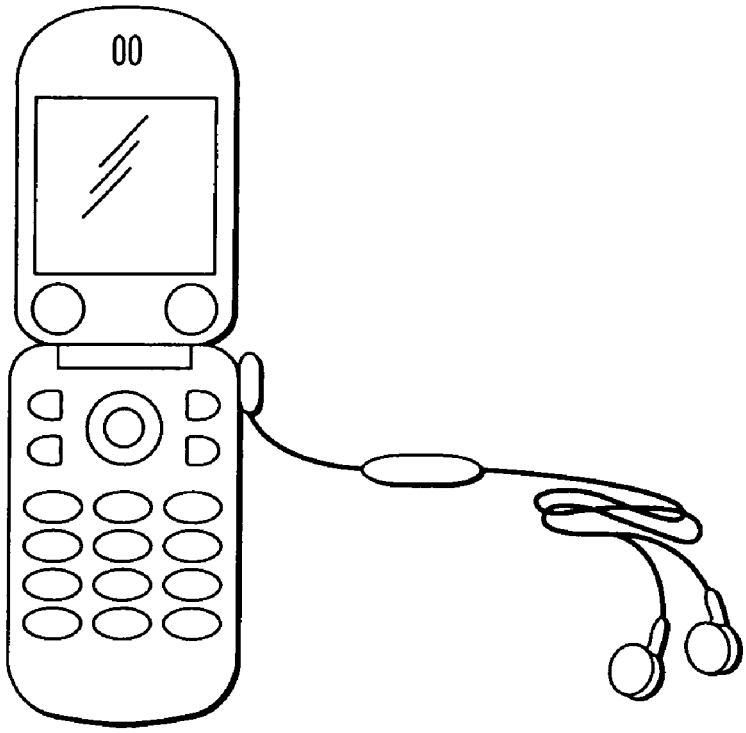
FIG. 13B is a diagram showing an appearance of a cellular phone with a built-in audio decoder as an example of the present invention.

FIG. 13 shows an example of an appearance of a mobile audio device equipped with the audio decoder of the present invention. FIG. 13A is a diagram showing an example of a mobile television with a built-in audio decoder of the present invention. FIG. 13B is a diagram showing an appearance of a cellular phone with a built-in audio decoder of the present invention. Regarding portable type devices as shown in the drawing, in a case where the number of operations per unit time is large, the circuit area unexpectedly increases in size for parallelization of the operations processing. Thus 2-channel reproduction is still the most popular in mobile audio device. Accordingly in the mobile audio device as shown in the drawing, the coded signal generated by coding a signal by the audio encoder of the present invention is decoded and is reproduced, the unnecessary parts of the coded signal are, therefore, skipped, and the virtual surround sound executed filtering by the head-related transfer function can be reproduced at low load.

The audio encoder of the present invention is an audio encoder for coding a multi-channel signal. The audio encoder generates a coded signal that allows the multi-channel signal to be reproduced by an inexpensive decoder. Therefore the audio encoder is applicable especially to mobile devices which are required to be downsized.

An audio decoder of the present invention is suitable for reproducing the coded multi-channel signal by a two-channel reproducing unit, for example by headphones. Therefore the audio decoder is applicable to such as mobile television, MD, SD and cellular phone.

The invention claimed is:

1. An audio decoder which decodes a coded signal, said decoder comprising: an obtaining unit operable to obtain coded signals including a) a first coded signal obtained by coding a two-channel stereo signal downmixed from a multi-channel signal exceeding two channels, b) a second coded signal obtained by coding information for generating a multi-channel signal from the stereo signal, and c) a signal representing a code size of the second coded signal; and a decoding unit configured to decode the obtained coded signals, and to output a stereo signal. wherein said decoding unit includes:

a first coded signal readout unit configured to read the first coded signal out of the obtained coded signals; a code size readout unit configured to read a signal representing a code size of the second coded signal out of the coded signals; and a first decoding unit configured to decode the first coded signal read out by said first coded signal readout unit, and to output the stereo signal, Wherein said code size readout unit is also configured to remove or skip the second coded signal based on the code size read out by said code size readout unit.

2. The audio decoder according to claim 1, wherein the first coded signal is coded from a stereo signal to which virtual surround-sound effect is applied beforehand by the operation using a head-related transfer function, and said first decoding unit is configured to output the stereo signal to which virtual surround-sound effect is applied.

3. The audio decoder according to claim 1, wherein the signal representing the code size of the second coded signal read out of the obtained coded signals is a signal representing the code size of the second coded signal having invalid data.

4. The audio decoder according to claim 1, wherein said decoding unit further includes:

a second coded signal readout unit figured to read the second coded signal out of the coded signals; a second decoding unit configured to decode a multi-channel signal based on the read-out first coded signal and the read-out second coded signal; a filter unit configured to perform filter processing to the decoded multi- channel signal based on the head-related transfer function, and to output the stereo signal to which virtual surround-sound effect is applied; and a selecting unit configured to select one of the stereo signal outputted out of the first decoding unit and the stereo signal to which virtual surround-sound effect is applied outputted out of said filter unit.

5. The audio decoder according to claim 4, wherein said first decoding unit is configured to generate a frequency domain signal of the stereo signal, and said filter unit is configured to perform filter processing based on the head-related transfer function to the frequency domain signal of the restored multi-channel signal from the frequency domain signal of the stereo signal, to generate a two-channel frequency domain signal, and subsequently to convert the frequency domain signal to a time domain signal.

6. An audio decoding method for decoding a coded signal, said method comprising:

obtaining coded signals including a) a first coded signal obtained by coding a two- channel stereo signal downmixed from a multi-channel signal exceeding two channels, b) a second coded signal obtained by coding information for generating a multi-channel signal from the stereo signal and c) a signal representing a code size of the second coded signal; and decoding the obtained coded signal and outputting a stereo signal, wherein the decoding of the obtained coded signal further includes: reading the first coded signal out of the obtained coded signals via a first coded signal readout unit; reading a signal representing a code size of the second coded signal out of the coded signals via a code size readout unit; the code size readout unit configured to read the signal representing a code size of the second coded signal out of the coded signals; and said code size readout unit is also configured to remove or skip the second coded signal based on the code size read out by said code size readout unit.

7. A program stored on a computer-readable storage medium for-and used in an audio decoder which decodes a coded signal, said program causing a computer to function as the following respective units: an obtaining unit configured to obtain coded signals including a) a first coded signal obtained by coding a two-channel stereo signal downmixed from a multi-channel signal exceeding two channels, b) a second coded signal obtained by coding information for generating a multi-channel signal from the stereo signal, and c) a signal representing a code size of the second coded signal; and a decoding unit configured to decode the obtained coded signals, and outputs a stereo signal, wherein said program further causes the decoding unit to operate as: a first coded signal readout unit configured to read the first coded signal out of the obtained coded signals; a code size readout unit configured to read a signal representing a code size of the second coded signal out of the coded signals; and a first decoding unit configured to decode the first coded signal read out by said first coded signal readout unit, and to output the stereo signal, Wherein said code size readout unit is also configured to remove or skip the second coded signal based on the code size read out by said code size readout unit.

* * * * *

UNITED STATES PATENT AND TRADEMARK OFFICE

CERTIFICATE OF CORRECTION

PATENT NO. : 7,613,306 B2
APPLICATION NO. : 10/586905
DATED : November 3, 2009
INVENTOR(S) : Shuji Miyasaka et al.

It is certified that error appears in the above-identified patent and that said Letters Patent is hereby corrected as shown below:

In the Claims

In column 16, claim 7, (original claim 19), line 66, "for-and used" should read --and used--.

Signed and Sealed this

Twenty-ninth Day of June, 2010

David J. Kappos

David J. Kappos
*Director of the United States Patent and Trademark Office*